US006879290B1

(12) United States Patent
Toutain et al.

(10) Patent No.: US 6,879,290 B1
(45) Date of Patent: Apr. 12, 2005

(54) COMPACT PRINTED "PATCH" ANTENNA

(75) Inventors: Yann Toutain, Brest (FR); Jean-Philippe Coupez, Brest (FR); Jean-Pierre Blot, La Turbie (FR)

(73) Assignee: France Telecom, Paris (FR)

( * ) Notice: Subject to any disclaimer, the term of this patent is extended or adjusted under 35 U.S.C. 154(b) by 6 days.

(21) Appl. No.: 10/653,885

(22) Filed: Sep. 4, 2003

Related U.S. Application Data

(63) Continuation of application No. 10/023,978, filed on Dec. 21, 2001, now abandoned.

(30) Foreign Application Priority Data

Dec. 26, 2000 (FR) ..... 00 17257

(51) Int. Cl.[7] ..... H01Q 1/38
(52) U.S. Cl. ..... 343/700 MS; 29/600
(58) Field of Search ..... 343/700 MS, 846; 29/600

(56) References Cited

U.S. PATENT DOCUMENTS

| | | | | |
|---|---|---|---|---|
| 4,131,894 A | * | 12/1978 | Schiavone | 343/700 MS |
| 5,061,938 A | * | 10/1991 | Zahn et al. | 343/700 MS |
| 5,448,249 A | * | 9/1995 | Kushihi et al. | 343/700 MS |
| 5,477,231 A | * | 12/1995 | Medard | 343/700 MS |
| 5,559,521 A | * | 9/1996 | Evans et al. | 343/700 MS |

* cited by examiner

*Primary Examiner*—Michael C. Wimer
(74) *Attorney, Agent, or Firm*—Lawrence E. Laubscher, Sr.

(57) ABSTRACT

A half-wave printed "patch" antenna includes, symmetrically with respect to a plane of symmetry of the antenna perpendicular to faces of the antenna, a dielectric substrate and two conductive layers on respective faces of the substrate. One face of the substrate includes a raised portion extending lengthwise of the plane of symmetry and one of the conductive layers extends over and along said raised portion. Consequently, the antenna has a small size, combined with a more open radiation diagram. The antenna includes only one raised portion for linear polarization, or two raised portions or a raised portion with axial symmetry for crossed polarizations.

11 Claims, 5 Drawing Sheets

COMPACT PRINTED "PATCH" ANTENNA

REFERENCE TO RELATED APPLICATION

This application is a continuation of application Ser. No. 10/023,978 filed Dec. 21, 2001.

BACKGROUND OF THE INVENTION

1. Field of the Invention

The present invention relates to a plated technology "patch" printed antenna, for operation with linear or circular polarization at frequencies of the order of a few gigahertz. In particular, the antenna is intended to be replicated in order to be integrated into an array for receiving and/or sending telecommunication signals on board a craft, such as a satellite in low earth orbit, or to be installed in a base station in communication with a telecommunication satellite, or to be installed in a base station for radio communications with mobile terminals.

2. Description of the Prior Art

The invention is more particularly directed to a "patch" half-wave printed antenna including a dielectric substrate and two conductive layers on respective faces of the substrate. One of the layers constitutes a ground plane. The other layer is a rectangular or square conductive plate known as a "patch". This kind of individual printed antenna is easy to integrate and has a low fabrication cost thanks to a simple machining process.

However, the electrical characteristics of the antenna depend considerably on the dielectric material of the substrate on which the two conductive layers are etched.

If the dielectric substrate is thin and has a high dielectric permittivity, the antenna is relatively inefficient and its bandwidth is narrow.

To obtain a more efficient antenna the dielectric substrate must be thick and consist of a material with a low dielectric permittivity. However, the antenna obtained in this way is significantly larger, which makes it difficult to integrate it into an array. Also, the radiation diagram of the antenna is less open.

OBJECT OF THE INVENTION

The main object of this invention is to provide a highly efficient "patch" half-wave printed antenna of smaller size than in the prior art referred to above and having a more open radiation diagram.

SUMMARY OF THE INVENTION

Accordingly, a half-wave printed antenna comprising a dielectric substrate and two conductive layers extending on respective faces of the substrate and symmetrical with respect to a plane of symmetry of the antenna perpendicular to the faces of the substrate, is characterized in that a raised portion extends lengthwise of the plane of symmetry on one face of the substrate, one of said conductive layers extending over and along the raised portion.

For an antenna with linear polarization, the conductive layer extending over and along the raised portion can have a contour for example rectangular and constitute a radiating element, and the other conductive layer can constitute a ground plane. According to another embodiment, the conductive layer extending over and along the raised portion can constitute a ground plane and the other conductive layer can be plane, for example rectangular, and constitute a radiating element.

The raised portion which can have a cross section in the plane of symmetry that is rectangular, sinusoidal, trapezoidal or triangular, has a height substantially equal to half the distance between the lengths of the longer and shorter sides of the layer, which is rectangular, extending over and along the raised portion. However, the height of the raised portion is generally chosen as a function of the intended compactness of the antenna; as the height of the raised portion increases, the size of the antenna decreases.

The other face of the substrate can include another raised portion extending lengthwise of the plane of symmetry and covered by the other conductive layer.

For an antenna with crossed polarizations, in particular circular or elliptical polarization, one face of the substrate includes two mutually perpendicular raised portions forming a striking cross, extending lengthwise of two respective planes of symmetry of the antenna. The conductive layer of the antenna extending over and along the raised portions can occupy a rectangular or square surface on the dielectric substrate whose sides are the same lengths as the respective raised portions.

The antenna with crossed polarizations preferably includes a hybrid coupler that is formed on a dielectric support and lodged in the dielectric substrate and has a port connected to an end of an inner conductor of a coaxial probe and at least another port connected by a metal via to the conductive layer extending over and along one of the raised portions.

In variant, the two raised portions on one face of the substrate are replaced by a raised portion with axial symmetry about an axis perpendicular to the faces of the substrate.

The invention also relates to a method of fabricating the "patch" printed antenna, which method includes machining one face of a block of dielectric substrate to form cavities separated by at least one strip having the same section as a raised portion extending lengthwise of the plane of symmetry, metallizing at least the face of the block with the machined dielectric raised portion to form one of the conductive layers, and cutting out the printed antenna substantially at the center of the metallized and machined block following the contour of the antenna.

BRIEF DESCRIPTION OF THE DRAWINGS

Other features and advantages of the present invention will become more clearly apparent on reading the following description of preferred embodiments of the invention, which description is given with reference to the accompanying drawings.

DESCRIPTION OF THE PREFERRED EMBODIMENTS

Figure 1:
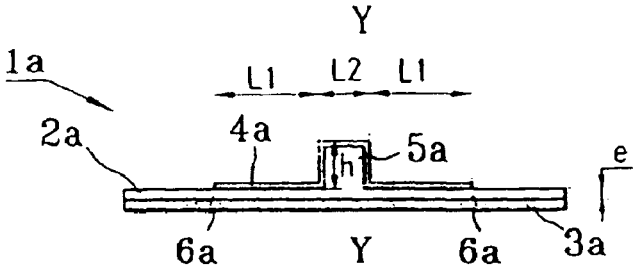
FIGS. 1 and 2 are respectively a view in section taken along the line I—I in FIG. 2 and a plan view of a "patch" printed antenna with linear polarization conforming to a first preferred embodiment of the invention.
Figure 2:
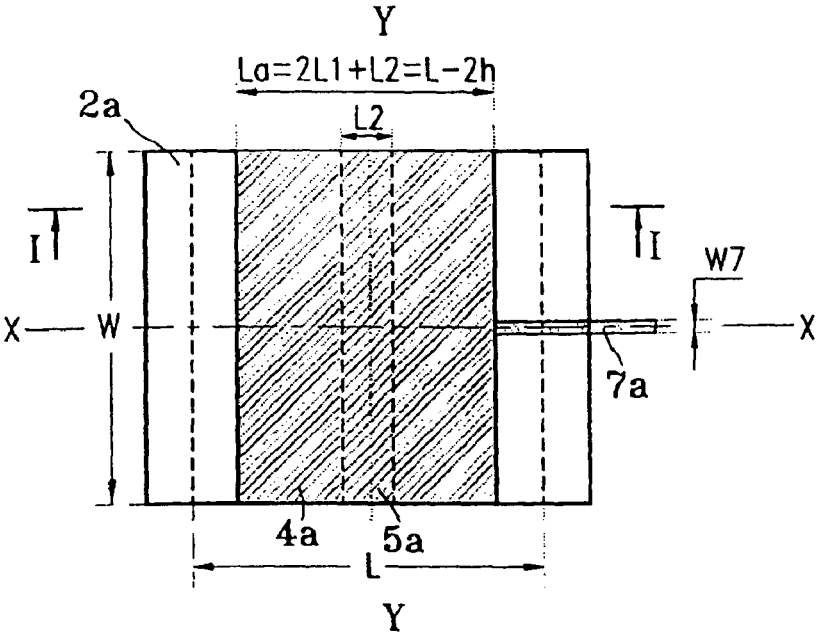

Referring to FIGS. 1 and 2, a "patch" half-wave printed antenna 1*a* with linear polarization conforming to the first embodiment of the invention includes a dielectric substrate 2*a*, a first electrically conductive layer 3*a* on a first face of the substrate and constituting a ground plane, and a rectangular second electrically conductive layer 4*a* at the center of the second face of the substrate and having a parallelepiped-shaped central raised portion 5*a*. The second conductive layer 4*a* has a rectangular contour and covers the top and the longitudinal sides of the raised portion 5*a*. The antenna therefore has a structure which is symmetrical with respect to a plane of symmetry YY perpendicular to the faces of the substrate 2*a* and lengthwise of the raised portion 5*a*. The layer 4*a* has a U-shaped section with projecting ends, as shown in FIG. 1, with wings on the second face of the substrate 2*a* having a width L1 much greater than the width L2 of the raised portion 5*a*. Generally speaking, the height h of the raised portion 5*a* is equal to or greater than the thickness e of the substrate 2*a*.

Compared to a prior art flat radiating patch having a width W and a length L, often equal to W, as shown in dashed line in FIG. 2, the length La of the antenna 1*a* according to the invention is reduced to:

$$La=2L1+L2=L-2h.$$

Thanks to the raised portion 5*a* across the whole width W of the antenna, the length of the radiating element consisting of the second conductive layer 4*a* is significantly reduced. This reduction in length moves the radiating slots 6*a* at symmetrical ends of the "patch" antenna 1*a* closer together, which opens out the radiation diagram in the plane of the electric field perpendicular to the raised portion 5*a*.

The substantial thickening at the center of the substrate 2*a* formed by the raised portion 5*a* covered with the conductive layer 4*a* extends the resonant electrical dimension of the half-wave antenna and thereby increases the characteristic impedance at the center of the antenna, which is equivalent to a pseudo-short-circuit. The raised portion significantly reduces the size of the antenna for a given operating frequency. As the impedance of the raised portion at the center of the antenna increases, the width L2 of the raised portion must decrease for a given frequency at resonance.

FIG. 2 also shows a microstrip line 7*a* having a width W7 significantly less than the width W of the radiating element 4*a* and extending perpendicularly thereto as far as the middle of the longer side of a wing of width L1 of the layer 4*a*. The microstrip line corresponds to a quarter-wave transformer and has the function of matching the impedance of the antenna to the characteristic impedance of the antenna feed line, which is typically 50 Ω. Another solution to feeding the antenna entails using a coaxial probe whose inner conductor is connected to a point of the antenna, such as a wing of the layer 4*a*, having an input impedance equal to the characteristic impedance.

Figure 3:
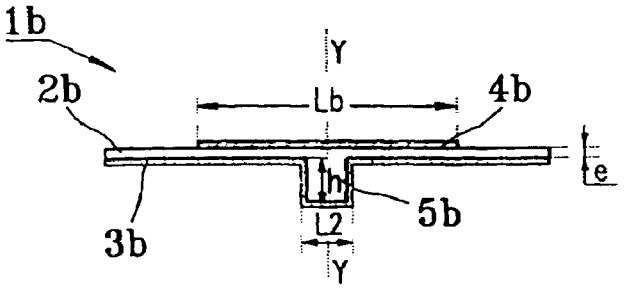
FIGS. 3 and 4 are respectively a view in section taken along the line III—III in FIG. 4 and a plan view of a "patch" printed antenna with linear polarization conforming to a second preferred embodiment of the invention.
Figure 4:
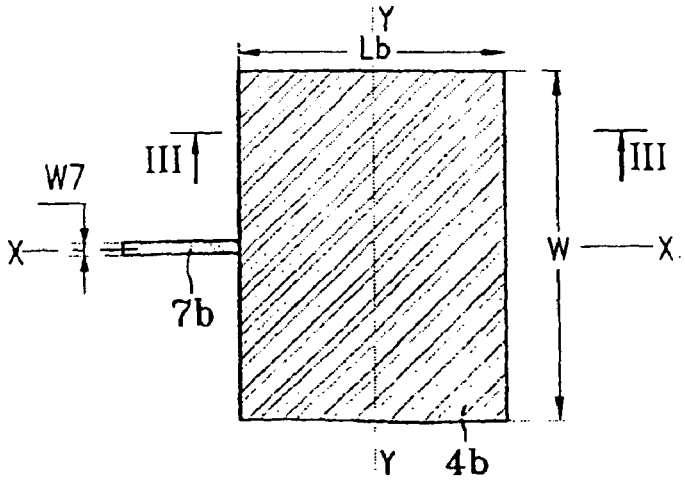

In FIGS. 3 and 4, which relate to a second embodiment of a "patch" half-wave printed antenna 1*b* according to the invention, components similar to those of the antenna 1*a* of the first embodiment are designated by the same reference number with the suffix b in place of the suffix a.

The "patch" half-wave printed antenna 1*b* is a dual variant of the first embodiment and is again symmetrical with respect to a plane of symmetry YY perpendicular to the faces of the substrate 2*b*. The symmetrical raised portion 5*a*, instead of being on the second face of the dielectric substrate 2*a* supporting the rectangular radiating element 4*a*, is on the first face of the substrate 2*b* supporting the first conductive layer 3*b* constituting the ground plane of the antenna 1*b*. The radiating element 1*b* is a completely plane rectangular conductive patch 4*b* over and extending along the axis of the raised portion 5*b*. The length Lb of the conductive layer 4*b* still conforms to the preceding equation:

$$Lb=L-2h$$

where h denotes the height of the raised portion 5*b* of width L2.

By way of example, table I below indicates the resonant frequency corresponding to a wavelength λ, the bandwidth centered on the resonant frequency, as a percentage thereof, and the directivity, firstly for a prior art antenna TA including a square plane patch of width W=L=50 mm=$\lambda/(2\sqrt{\epsilon_r})$ and a substrate having a thickness e=2 mm and made from foam having a relative permittivity $\epsilon_r$=1.07, substantially equivalent to a layer of air, and secondly for conformal antennas 1*a*1 to 1*a*4 with linear polarization conforming to the first embodiment (FIGS. 1 and 2) and with a length La=L−2h<$\lambda/(2\sqrt{\epsilon_r})$.

TABLE 1

| | TA | 1a1 | 1a2 | 1a3 | 1a4 |
|---|---|---|---|---|---|
| h (mm) | 0 | 2 | 4 | 6 | 8 |
| Resonant frequency (GHz) | 2.63 | 2.43 | 2.28 | 2.21 | 2 |
| Bandwidth | 1.7% | 1.9% | 2% | 2.2% | 2.4% |
| Directivity (dB) | 9.4 | 8.47 | 7.68 | 7.14 | 6.64 |

From table 1 above, as the height h of the raised portion 5*a*, or to be more precise the ratio h/e, increases, and to a lesser degree, as the width L2 of the raised portion 5*a* increases, the bandwidth of the antenna increases and the directivity of the antenna decreases.

Figure 5:
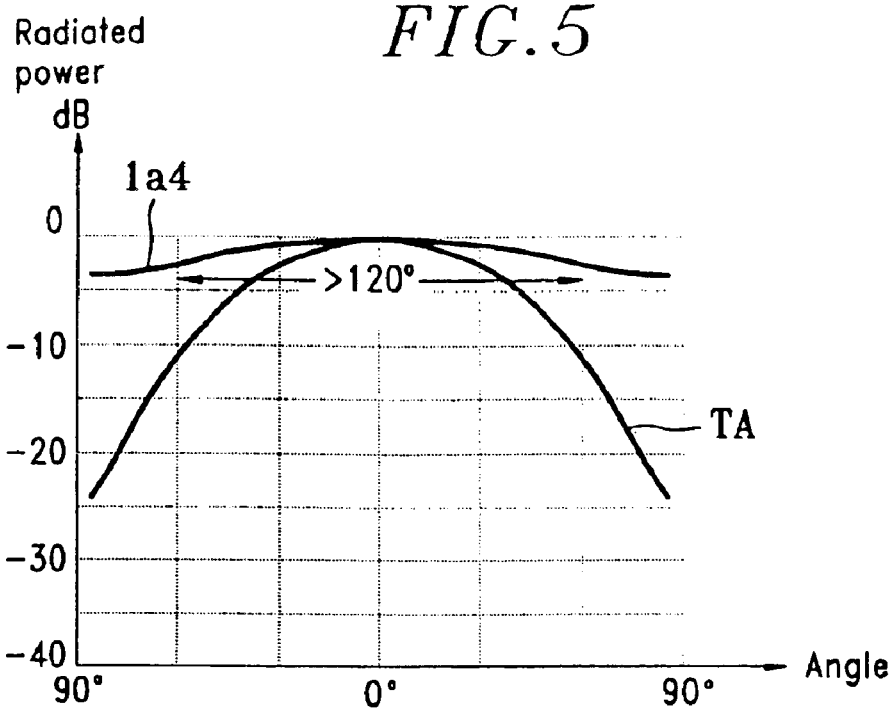
FIG. 5 shows two electric field radiation diagrams respectively relating to a "patch" antenna of the prior art and a "patch" antenna conforming to the first embodiment.

As shown in FIG. 5, the radiation diagram in the plane of the electric field perpendicular to the raised portion 5*a* has an aperture proportional to the height h of the raised portion, which is much wider, for the antenna 1*a*4, for example, than the aperture of the radiation diagram of the prior art antenna TA. The aperture of the antenna 1*a*4 at half the radiated power (3 dB) is approximately 120°.

These properties offer greater freedom with respect to the relative positions of antennas according to the invention placed in an array because of the relative reduction in the dimensions of the antenna. Also, the beam from an array of antennas according to the invention can be depointed to a much greater extent because the radiation diagram of the antenna is more open.

Thus by appropriately adapting the height h of the raised portion 5*a*, the aperture of the radiation diagram at 3 dB can vary from approximately 60° to at least approximately 120°. The radiation efficiency remains above 90% for all antennas according to the invention.

Similar results have been obtained for antennas 1*b*1 to 1*b*4 conforming to the second embodiment of the invention, with a conformal ground plane 3*b* with a raised portion 5*b*, as shown in table 2 below, again for antennas with the dimensions Lb=L=50 mm and e=2 mm.

TABLE 2

| | TA test | 1b1 | 1b2 | 1b3 | 1b4 |
|---|---|---|---|---|---|
| h (mm) | 0 | 2 | 4 | 6 | 8 |
| Resonant frequency (GHz) | 2.63 | 2.3 | 2.09 | 1.95 | 1.82 |
| Bandwidth | 1.7% | 1.9% | 2.1% | 2.3% | 2.5% |
| Directivity (dB) | 9.4 | 7.9 | 7 | 6.4 | 6.1 |

A preferred method for fabrication of a linear polarization antenna according to the invention includes four steps E1, E2, E3 and E4 shown in FIGS. 6–7, 8–9, 10–11 and 12–13, respectively.

In the initial step E1, fabrication starts with a thin block of foam BL of thickness h+e, of width greater than W and of length greater than La. The dielectric material of the block BL, into which the dielectric substrate 2*a* will be machined, has a typical relative permittivity of the order of 1.07, in conjunction with a length L=50 mm$<\lambda_r/2$ with $\lambda_r=\lambda/\sqrt{\epsilon_r}$, where $\lambda$ is the wavelength corresponding to a frequency of the order of 2 GHz.

In step E2, two rectangular cavities C with a bottom of thickness e are machined symmetrically with respect to the transverse axis in one face of the block BL so that the cavities are separated by a transverse strip BA having the same section (h×L2) as the raised portion 5*a*. The cavities C have a width greater than L1 and a length greater than W.

Then, in step E3, the top face of the block BL with the cavities is metallized by depositing a layer of metallic paint to constitute the conductive layer 4*a*. In particular, the metallic paint covers the strip BA and the bottom of the cavities C. The metallic paint also covers the bottom face of the block to constitute the ground plane 3*a*. As an alternative to this, instead of the metallization of the bottom face, the ground plane 3*a* can consist of a metal support to which the machined block of foam is fixed.

Finally, in step E4, the antenna 1*a* is cut at D by a second operation of machining the metallized block along the rectangular contour (W×La) of the conductive layer 4*a* and the elongate rectangular contour of the microstrip feed line 7*a*.

An antenna 1*b* with a conformal ground plane 3*b* with a raised portion 5*b* can equally be machined from a block of dielectric foam BL by method steps analogous to the above steps E1 to E4.

Figure 14:
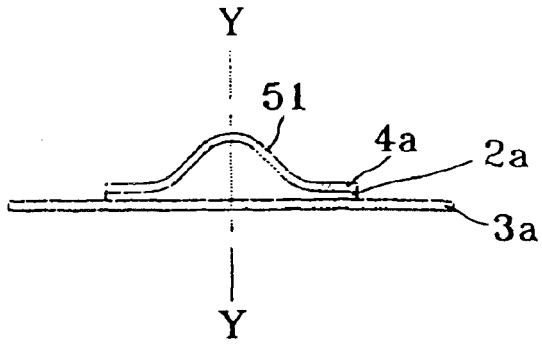
FIGS. 14 and 15 are views in section analogous to FIG. 1, respectively showing raised portions with a sinusoidal profile and a staircase profile.
Figure 15:
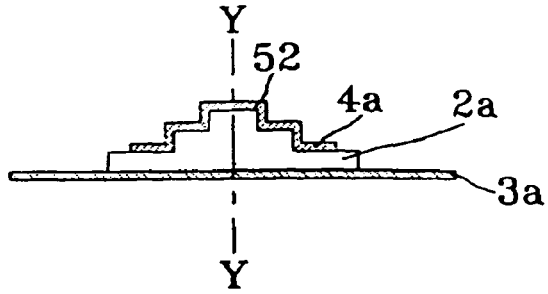

The section of the raised portion 5*a*, 5*b* transverse to the plane of symmetry YY is not limited to the rectangular or square profile shown in FIGS. 1 and 3. Reducing the length of the antenna from L to La, Lb, generating a central area of very high impedance, can be the result of some other symmetrical profile of the cross section of the raised portion, for example a substantially sinusoidal profile 51, as shown in FIG. 14, or a substantially isosceles trapezoidal or isosceles triangular profile, or a substantially staircase-shaped profile 52, as shown in FIG. 15, with treads parallel to or inclined to the faces of the substrate.

Figure 16:
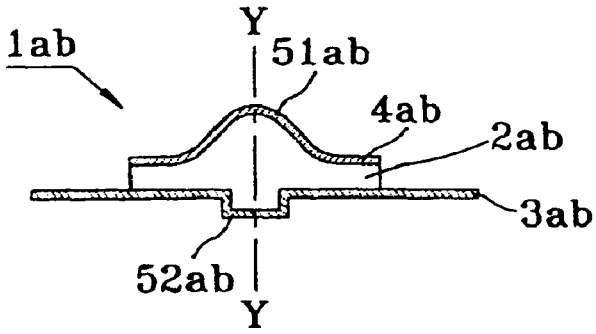
FIG. 16 is a view in section analogous to FIGS. 1 and 3 of an antenna with two superposed raised portions on two respective faces of the substrate.

In another embodiment, the antenna comprises stacked parallel raised portions on both faces of the substrate. For example, as shown in FIG. 16, the faces of the substrate 2*ab* of the antenna 1*ab* respectively include a first raised portion 52*ab* with a rectangular cross section for the first conductive layer 3*ab* of ground plane and a second raised portion 51*ab* with a sinusoidal cross section for the second conductive layer 4*ab* of radiating element. The raised portions 52*ab* and 51*ab* extend one on top of the other lengthwise of the plane of symmetry YY and are respectively covered by the layers 3*ab* and 4*ab*.

Compared to a ground return quarter-wave antenna that is not symmetrical with respect to two planes, and despite the raised portions 5*a*, 5*b*, the half-wave antenna 1*a*, 1*b* embodying the invention retains two-fold symmetry with respect to the plane of symmetry YY lengthwise of the raised portion and a plane of symmetry XX perpendicular to the raised portion and lengthwise of the feed line 7*a*, as indicated in FIGS. 2 and 4.

This two-fold symmetry confers the advantages of the raised portion on an antenna with two crossed polarizations, and more particularly an antenna with circular polarization described hereinafter.

Figure 17:
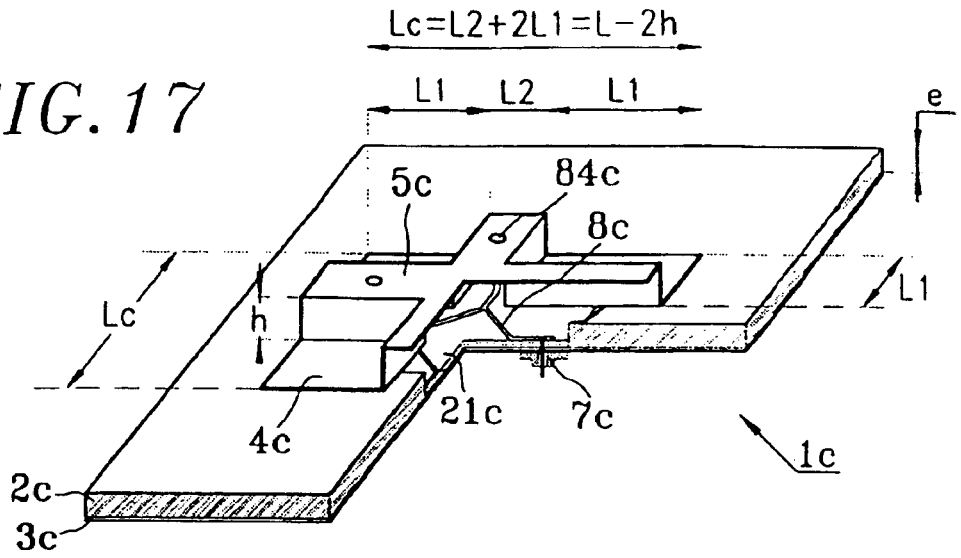
FIG. 17 is a perspective view of a "patch" printed antenna with circular polarization and a hybrid coupler, the antenna conforming to a third embodiment of the invention and a quarter-sector of the antenna being cut away.
Figure 18:
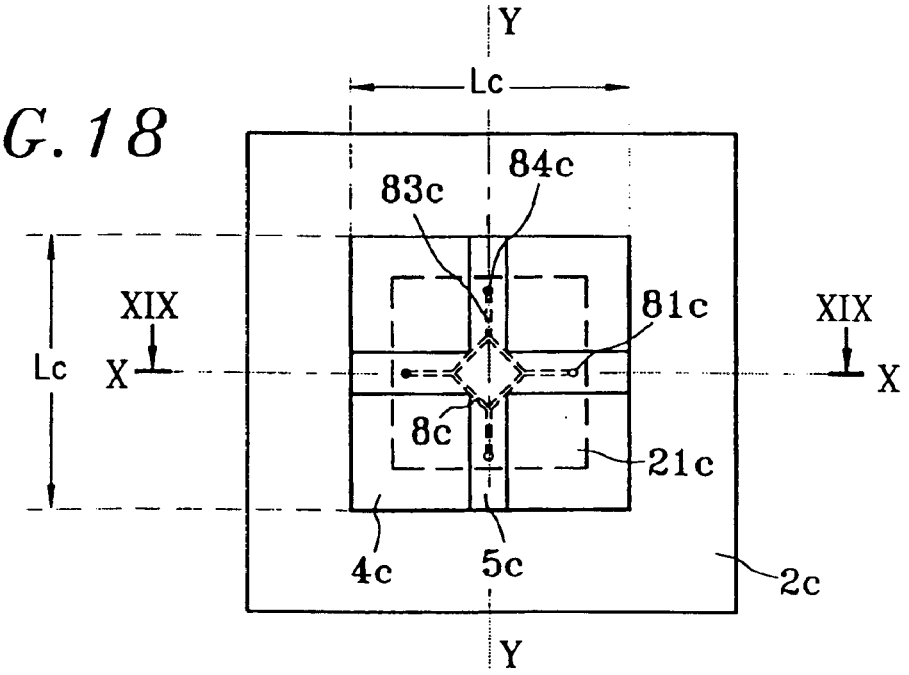
FIGS. 18 and 19 are respectively a plan view and a view in section taken along the line XIX—XIX of the antenna shown in FIG. 17.
Figure 19:
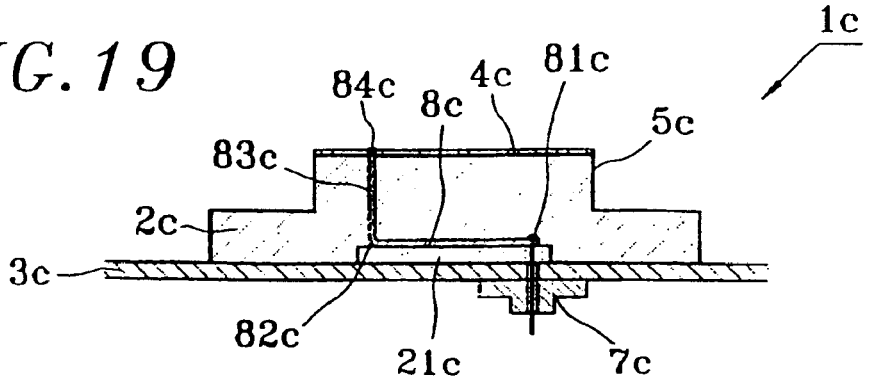

Referring now to FIGS. 17, 18 and 19, a circular polarization printed antenna 1*c* according to the invention has a structure with two-fold symmetry with respect to two planes of symmetry XX and YY perpendicular to each other and to the faces of the antenna.

The antenna 1*c* has on a first face of a thin dielectric substrate 2*c* of thickness e, a metal layer 3*c*, which can be a metal base, to constitute the ground plane of the antenna 1*c*, and at the center of a second face of the substrate 2*c*, a conductive layer 4*c* covering two identical and mutually perpendicular raised portions 5*c* to form a central cross with four equal-length arms. Like the raised portions 5*a* and 5*b*, the raised portions 5*c* have a height h that is generally greater than the thickness e of the substrate 2*c*, and a length Lc such that:

$$Lc=L2+2L1=L-2h$$

where L2 designates the width of each raised portion, L1 the width of the four square surfaces of the metallic layer 4*c* disposed on the second face of the substrate 2*c* at the base of the cross formed by the raised portions 5*c*, and L is the corresponding length of a plane square patch of a prior art antenna.

The antenna 1*c* therefore has two mutually perpendicular planes of symmetry XX and YY respectively lengthwise of the crossed raised portions 5*c* and a conductive layer 4*c* forming a radiating element on the substrate 2*c* having a smaller square surface (Lc×Lc).

In practice, the dielectric substrate 2*c* consists of a dielectric foam of low permittivity $\epsilon_r$=1.07, whose top face is machined in an analogous manner to the substrate 2*a*, 2*b* to obtain the crossed raised portions 5*c*, and a small square dielectric support 21*c* set into a central cavity on the first face of the substrate 2*c* and covered by the metal layer 3*c*. The relative permittivity of the support 21*c* is higher, for example $\epsilon_r$=10.2 in the case of an AR1000 dielectric from the firm ARLON.

As shown in detail in FIGS. 17 to 19, the antenna 1*c* is fed by a coaxial probe 7*c* whose outer conductive base is fixed to the ground plane 3*c* and whose inner conductor passes only through the dielectric support 21*c*. The end of the inner conductor of the coaxial probe 7*c* is soldered to the end of a branch 81*c* forming a port at one extremity of a 3 dB−90° hybrid coupler 8*c*. The coupler 8*c* is configured substantially according to the contour of a square and is photo-etched on the top face of the support 21*c*. Another port, situated at the front in FIGS. 17 and 18, can be connected to the inner conductor of a second coaxial probe (not shown) for operation with crossed polarizations. The other two ports 82*c* of the coupler 8*c* are extended by metallic vias 83*c* that are formed through the end of the two raised portions 5*c* and whose ends are in metallic contact through soldered connections 84*c* with the conductive layer 4*c* over the raised portions 5*c*.

The relative permittivity of the dielectric support 21*c* is much higher than that of the substrate 2*c* so that, for the operating frequencies of the antenna, which are of the order of one gigahertz, the dimensions of the coupling 8*c* are small and therefore compatible with the compactness of the antenna.

Insofar as the dielectric foam block 21*c* is concerned, the antenna 2*c* is fabricated, by substantially method steps analogous to the above steps E1 to E4, by machining four cavities to form two cruciform strips which, after cutting, form the two perpendicular raised portions 5*c*, and by excavating an underlying cavity to lodge the dielectric support 21*c* supporting the hybrid coupler 8*c*.

For example, the dielectric substrate 21*c* has an overall thickness e of 10 mm with a 635 $\mu$m thick cavity to lodge the 635 $\mu$m thick dielectric support 21*c*. The conductive layer 4*c* covering the crossed raised portions 5*c* has a width Lc=25 mm for raised portions 5*c* having a height h=8 mm relative to a usable thickness e=2 mm of the substrate 2*c*.

Figure 20:
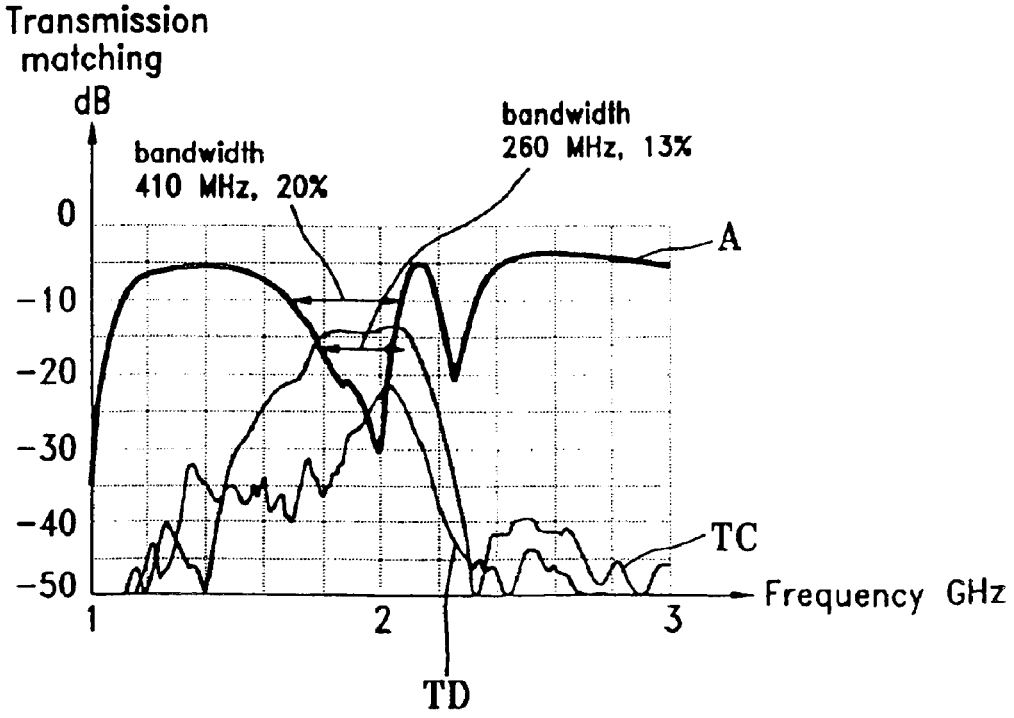
FIG. 20 shows variations of matching and transmission as a function of frequency for the third embodiment of the antenna.
Figure 6:
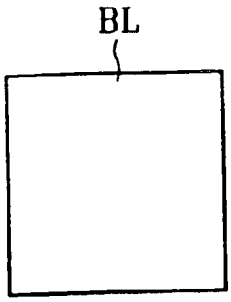
FIGS. 6 and 7 are respectively plan and perspective views of an unprocessed block of dielectric foam during a first step of fabricating an antenna according to the invention.
Figure 7:
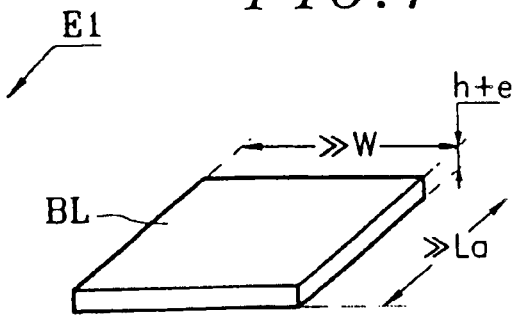
Figure 8:
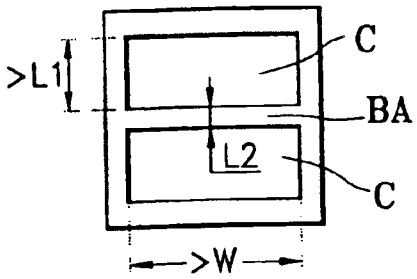
FIGS. 8 and 9 are respectively plan and perspective views of the machined block of dielectric foam during a second step of the fabrication method.
Figure 9:
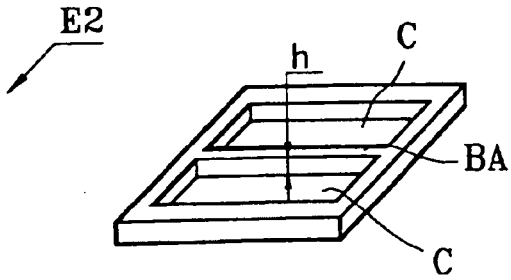
Figure 10:
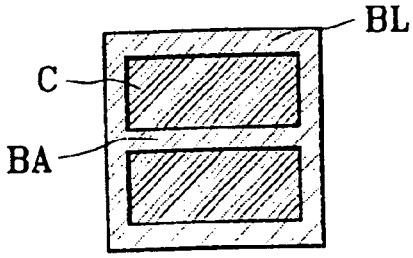
FIGS. 10 and 11 are respectively plan and perspective views of the machined and metallized block of foam during a third step of the fabrication method.
Figure 11:
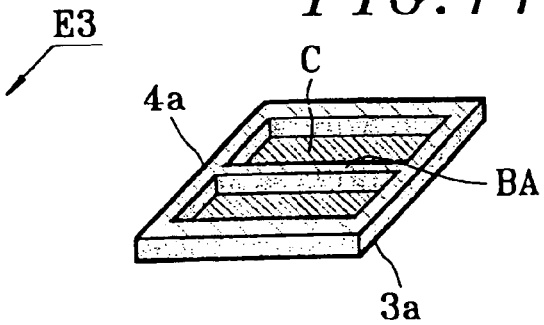
Figure 12:
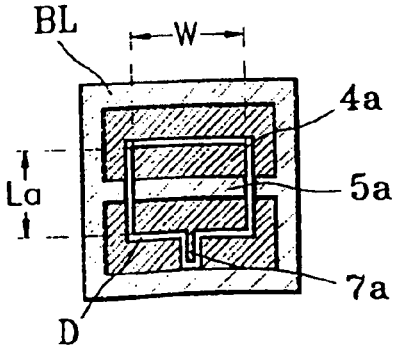
FIGS. 12 and 13 are respectively plan and perspective views of the machined and metallized block of foam after another machining step of the fabrication method.
Figure 13:
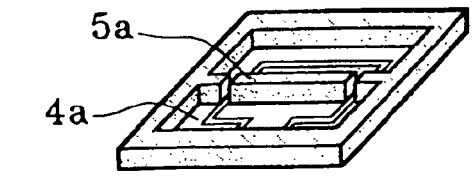

For the antenna 1*c* with the above dimensions, FIG. 20 shows, as a function of frequency, the matching A and the transmission TC for the preferred, circular polarization rotating in the anticlockwise direction, compared to transmission TD rotating in the clockwise direction. The antenna resonates at a frequency around 2 GHz with matching of approximately 20% at 10 dB, which corresponds to a bandwidth of 410 MHz. The effective transmission bandwidth is narrower, of the order of 13%.

As an alternative to the above, the lengths of the raised portions 5*c* can be different for operation with elliptical polarization with one probe or crossed polarization with two probes.

Figure 21:
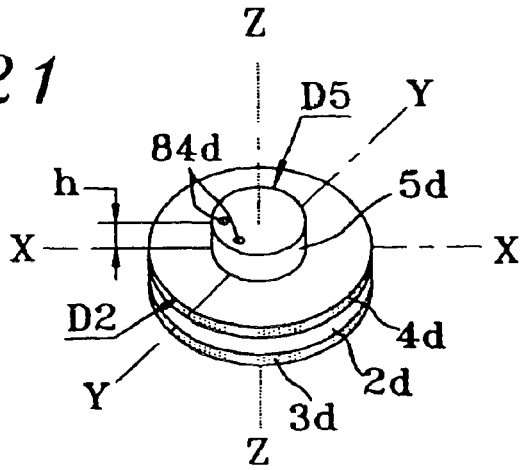
FIG. 21 is a perspective view of a printed antenna with crossed polarizations.

The invention is not limited to the crossed parallelepiped-shaped raised portions 5*c* for operation with crossed polarizations, especially operation with circular polarization. For example, the two raised portions can be replaced by a central raised portion with axial symmetry about a central axis of symmetry ZZ perpendicular to the faces of the substrate 2*d* covered with the conductive layers 3*d* and 4*d*. In the example shown in FIG. 21, the raised portion 5*d* is in the shape of a macaroon. More generally, the raised portion has a discoid, frustoconical, conical, dome or bell shape, with a circular or elliptical base on the substrate. At least two feed coupler ends 84*d* are provided on the raised portion 5*d*, on two axes perpendicular to each other and to the axis of symmetry ZZ, at the same distance or different distances from the axis ZZ.

What we claim is:

1. A half-wave printed antenna, comprising:

(a) a dielectric substrate having a pair of parallel faces on opposite sides thereof;

(b) a radiating element conductive layer on a first one of said substrate faces; and (c) a ground plane conductive layer on the second one of said substrate faces, said conductive layers being symmetrical with respect to a plane of symmetry (Y—Y) of said antenna normal to said substrate faces;

(d) said substrate including a raised portion extending lengthwise of said plane of symmetry on one of said substrate faces centrally beneath said radiating element conductive layer, said raised portion having a width in a direction normal to said plane of symmetry that is less than the width of said radiating element;

(e) one of said conductive layers extending over and along said raised portion.

2. The antenna as claimed in claim 1, wherein said conductive layer extending over and along said raised portion constitutes said radiating element, and the other conductive layer constitutes said ground plane.

3. The antenna as claimed in claim 1, wherein said it conductive layer extending over and along said raised portion constitutes said ground plane, and the other conductive layer constitutes said radiating element.

4. The antenna as claimed in claim 1, wherein said raised portion has a rectangular, sinusoidal, trapezoidal or triangular cross section in said plane of symmetry.

5. A half-wave printed antenna, comprising:

(a) a dielectric substrate having a pair of parallel faces on opposite sides thereof;

(b) a radiating element conductive layer on a first one of said substrate faces; and (c) a ground plane conductive layer on the second one of said substrate faces, said conductive layers being symmetrical with respect to a plane of symmetry (Y—Y) of said antenna normal to said substrate faces;

(d) said substrate including a raised portion extending lengthwise of said plane of symmetry on one of said substrate faces centrally beneath said radiating element conductive layer, said raised portion having a width in a direction normal to aid plane of symmetry that is less than the width of said radiating element;

(e) one of said conductive layers being rectangular and extending over and along said raised portion said raised portion having a height substantially equal to half the distance between the lengths of the longer and shorter sides of said one conductive layer.

6. A half-wave printed antenna, comprising:

(a) a dielectric substrate having a pair of parallel faces on opposite sides thereof;

(b) a first radiating element conductive layer arranged on a first one of said substrate faces; and (c) a ground plane conductive layer on the second one of said substrate faces, said conductive layers being symmetrical with respect to a plane of symmetry (Y—Y) of said antenna normal to said substrate faces;

(d) each of said substrate faces including a raised portion extending lengthwise of said plane of symmetry and being covered by said conductive layers, respectively, said raised portions extending centrally beneath said conductive layers and having a width in a direction normal to said plane of symmetry that is less than the width of said radiating element.

7. A half-wave printed antenna, comprising:

(a) a dielectric substrate having a pair of parallel faces on opposite sides thereof;

(b) a radiating element conductive layer on a first one of said substrate faces; and (c) a ground plane conductive layer on the second one of said substrate faces, said conductive layers being symmetrical with respect to a plane of symmetry (Y—Y) of said antenna normal to said substrate faces;

(d) one face of said substrate including two mutually perpendicular raised portions (5*c*) extending lengthwise of two respective planes of symmetry of said antenna centrally beneath said radiating element conductive layer each of said raised portions having a width (L2) in a direction normal to said plane of symmetry that is less than the width (Lc) of the radiating element.

8. The antenna as claimed in claim 7, wherein said conductive layer extending over and along said raised portions occupies a rectangular surface on said dielectric substrate whose sides are the same lengths as the respective raised portions.

9. The antenna as claimed in claim 7, wherein said two raised portions together have axial symmetry about an axis normal to said first and second substrate faces.

10. A half-wave printed antenna, comprising:

(a) a dielectric substrate having a pair of parallel faces on opposite sides thereof;

(b) a radiating element conductive layer on a first one of said substrate faces; and (c) a ground plane conductive layer on the second one of said substrate faces, said conductive layers being symmetrical with respect to a plane of symmetry of said antenna normal to said substrate faces;

(d) said substrate including two mutually perpendicular raised portions extending lengthwise of two respective planes of symmetry on one of said substrate faces and having a width less than the width of said radiating element;

(e) one of said conductive layers extending over and along said raised portion;

(f) said antenna further including a hybrid coupler that is formed on a dielectric support and is lodged in said dielectric substrate, said hybrid coupler having at least one port connected to an end of an inner conductor of a coaxial probe, and at least another port connected by a metallic lead to said conductive layer extending over and along said raised portions.

11. A method of fabricating a half-wave printed antenna including a dielectric substrate and two conductive layers extending on respective faces of said substrate and symmetrical with respect to a plane of symmetry of said antenna perpendicular to said face of said substrate, said method including machining one face of a block of dielectric substrate to form cavities separated by at least one strip having the same section as a raised portion extending lengthwise of said plane of symmetry, metallizing at least said face of said block with the machined dielectric raised portion to form one of said conductive layers, and cutting out said printed antenna substantially at the center of said metallized and machined block following the contour of said printed antenna.

* * * * *